US012758833B2

(12) United States Patent
Lai

(10) Patent No.: US 12,758,833 B2
(45) Date of Patent: Oct. 13, 2026

(54) GOLF BAG WITH DETACHABLE TELESCOPIC TUBE

(71) Applicant: Wei Hung Lai, Taichung (TW)

(72) Inventor: Wei Hung Lai, Taichung (TW)

( * ) Notice: Subject to any disclaimer, the term of this patent is extended or adjusted under 35 U.S.C. 154(b) by 0 days.

(21) Appl. No.: 19/009,462

(22) Filed: Jan. 3, 2025

(65) Prior Publication Data

US 2026/0192165 A1 Jul. 9, 2026

(51) Int. Cl.
*A63B 55/40* (2015.01)

(52) U.S. Cl.
CPC ..... *A63B 55/40* (2015.10); *A63B 2225/093* (2013.01)

(58) Field of Classification Search
CPC ..... A63B 55/40; A63B 2225/093
USPC ..... 206/315.3
See application file for complete search history.

(56) References Cited

U.S. PATENT DOCUMENTS 4,782,948 A * 11/1988 Weise ..... A63B 55/50 206/315.7
4,911,292 A * 3/1990 Airey, Jr. ..... A63B 55/00 206/315.3
5,573,112 A * 11/1996 Kim ..... A63B 55/40 206/315.6
5,725,095 A * 3/1998 Beck ..... A63B 55/40 277/408
9,827,471 B1 * 11/2017 Wang ..... A63B 55/57
2021/0077873 A1 * 3/2021 Lai ..... A63B 55/40
2022/0184476 A1 * 6/2022 Zhang ..... A63B 55/40
2024/0042290 A1 * 2/2024 Lai ..... A63B 55/30
2024/0325834 A1 * 10/2024 Cheng ..... A63B 55/57

* cited by examiner

*Primary Examiner* — Nathan J Jenness
*Assistant Examiner* — Justin Caudill
(74) *Attorney, Agent, or Firm* — Sinorica International Patent & Trademark

(57) ABSTRACT

A golf bag comprises a bag body, a head frame assembly and a telescopic tube. The bag body has a storage space and an opening communicating with the storage space. The head frame assembly is arranged in the bag body, comprising a first head frame, a second head frame, and a control member. When the control member switches to the closed state, the control member secures the second head frame to the first head frame. When the control member switches to the open state, the control member disengages from the first head frame, allowing the second head frame to detach from the first head frame. The telescopic tube is detachably arranged within the storage space of the bag body. When the second head frame is detached from the bag body, the telescopic tube is removable from the opening of the bag body.

8 Claims, 10 Drawing Sheets

GOLF BAG WITH DETACHABLE TELESCOPIC TUBE

BACKGROUND OF THE INVENTION

1. Technical Field

The present invention relates to a golf bag, and more particularly to a golf bag with telescopic tube.

2. Description of Related Art

For golf players, a golf bag is an essential tool for carrying and protecting golf clubs. Currently, the most common types of golf bags on the market can be categorized into two types: traditional golf bags and golf bags with telescopic tubes.

Traditional golf bags do not feature telescopic functionality and are generally not recommended for lateral transportation. They also do not provide adequate protection for golf clubs during transport. However, their advantage lies in their lighter weight, making them simpler and more convenient for everyday use. On the other hand, golf bags with telescopic tubes offer better protection for golf clubs during transport. However, the inclusion of the telescopic tube adds weight to the bag, making it heavier overall. This extra functionality is rarely needed during regular non-transport use, and since the telescopic tube cannot be detached, the bag becomes relatively inconvenient for daily use.

Since the two common types of golf bags each have their own advantages and disadvantages but cannot combine their functions and uses, consumers often need to choose based on their personal usage scenarios and needs. For those who wish to enjoy the benefits of both types, purchasing and alternating between the two types of golf bags is required, which significantly increases both economic and space costs. Therefore, how to provide a golf bag that combines the functions of these two types has become one of the critical challenges for professionals and researchers in the golf bag industry to address.

BRIEF SUMMARY OF THE INVENTION

In view of the above, the primary objective of the present invention is to provide a golf bag with detachable telescopic tube, allowing users to independently attach or detach the telescopic tube within the golf bag, thereby enhancing the functionality of the golf bag.

In order to achieve the objective of the present invention, A golf bag, comprising: A bag body having a storage space and an opening communicating with the storage space; wherein the bag body is provided with a plurality of supporting rods within the storage space, with a lower end of each support rods being fixed to a bottom side of the bag body and an upper end of each support rods extending toward the opening; A head frame assembly comprising a first head frame, a second head frame, and a control member; the first head frame being annular and having a plurality of hollow positioning members arranged on its outer periphery, wherein the supporting rods pass through the positioning members, thereby securing the first head frame within the storage space of the bag body; the second head frame being detachably connected to the first head frame by the control member, the control member being operable to switch between a closed state and an open state; wherein when the control member switches to the closed state, the control member secures the second head frame to the first head frame; when the control member switches to the open state, the control member disengages from the first head frame, allowing the second head frame to separate from the first head frame; A telescopic tube detachably arranged in the storage space of the bag body and movable along a direction towards or away from the bag body; wherein when the second head frame is detached from the bag body, the telescopic tube is removable from the opening of the bag body.

In an embodiment, the telescopic tube comprises a middle frame and a tube body; the middle frame, installed within the storage space of the bag body, having an annular wall and a bottom wall; the tube body, installed within the storage space of the bag body, having an inwardly concave portion on one end; an inner wall of the inward concave portion abuts against the annular wall of the middle frame, and a bottom surface of the inward concave portion rests against the bottom wall of the middle frame.

In an embodiment, an inner edge of the annular wall of the middle frame is provided with a plurality of track members respectively been passed through by the supporting rods, and an inner diameter of the track member is greater than an outer diameter of the positioning member; wherein a side of each track member is provided with a notch extending along an axial direction of the supporting rods.

In an embodiment, the control member is mounted in a center of the second head frame and includes a screw base and a knob; The screw base is detachably connected to a threaded hole of the first head frame; the knob is rotatably mounted on a top of the second head frame and connected to the screw base to driven the screw base to enter or leave the threaded hole.

In an embodiment, the screw base comprises a threaded portion and a shaft portion; the threaded portion is detachably connected to the threaded hole of the first head frame; the shaft portion extends from an end of the threaded portion and passes through a center of the second head frame, and an outer diameter of the shaft portion is smaller than an outer diameter of the threaded portion; An end of the knob is provided with a hollow tubular portion engaged with the shaft portion of the screw base.

In an embodiment, the screw base includes a plurality of ribs arranged around the junction between the threaded portion and the shaft portion; the tubular portion of the knob has a plurality of notches at one end, corresponding to the ribs; when the knob is connected to the screw base, the ribs engage with the notches, enabling the knob and the screw base to rotate synchronously.

In an embodiment, the head frame assembly further comprises a head frame outer sleeve detachably fitted around an outer periphery of the second head frame to fill the gap between the second head frame and the bag body when the second head frame is positioned within the storage space of the bag body.

In an embodiment, the outer periphery of the second head frame is provided with a plurality of engaging slots, and an inner periphery of the head frame outer sleeve is provided with a plurality of engaging members extending inwardly and corresponding to the engaging slots; when the second head frame and the head frame outer sleeve are assembled, the engaging members engages with the engaging slots.

In an embodiment, the head frame outer sleeve is not assembled with the second head frame when the telescopic tube is mounted within the bag body.

In an embodiment, the second head frame comprises a shell member and a flexible member; the flexible member is mounted on the shell member, and a flexibility of the flexible member is greater than that of the shell member.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
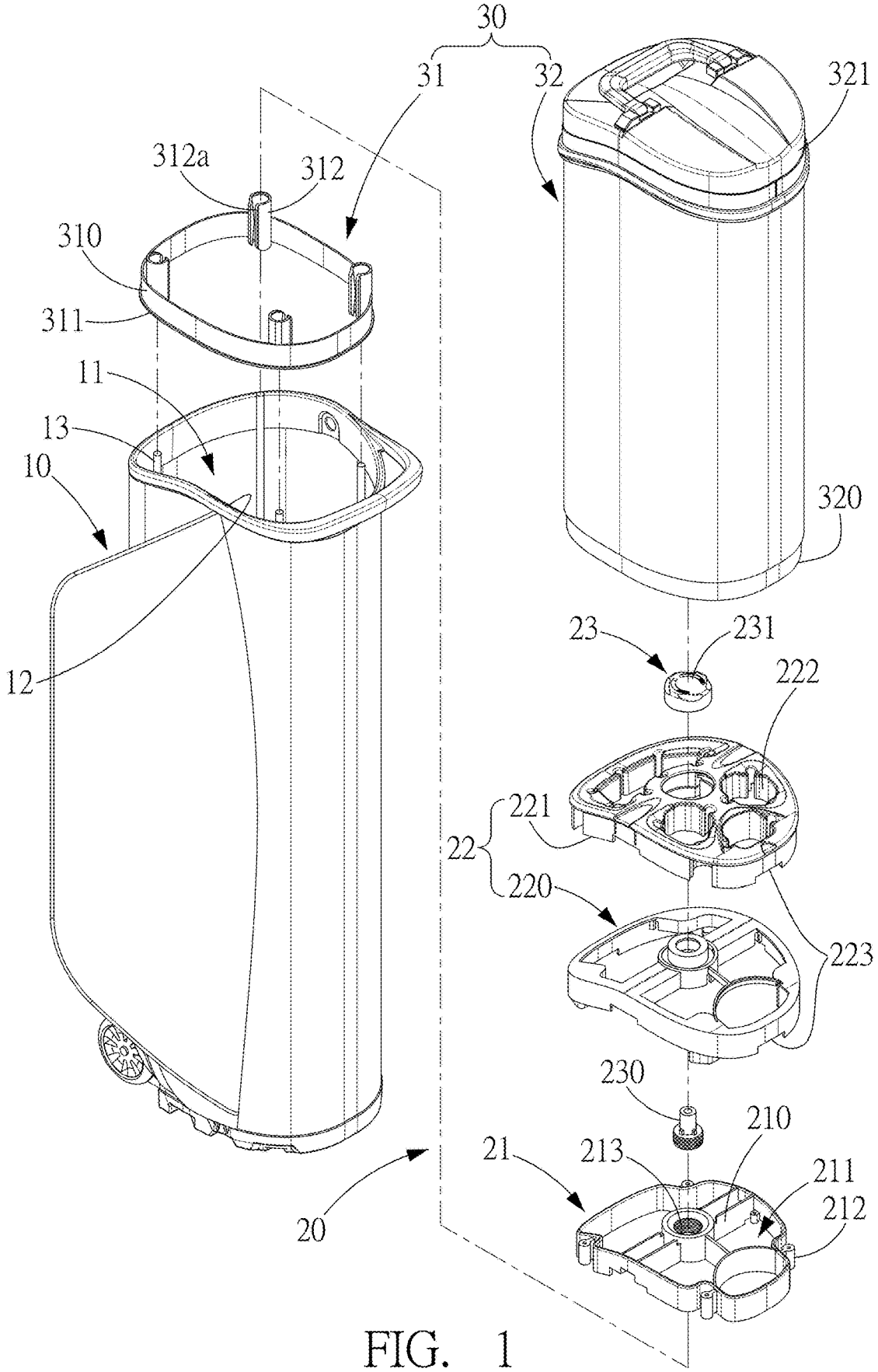
FIG. 1 is an exploded view of a preferred embodiment of the present invention.
Figure 2:
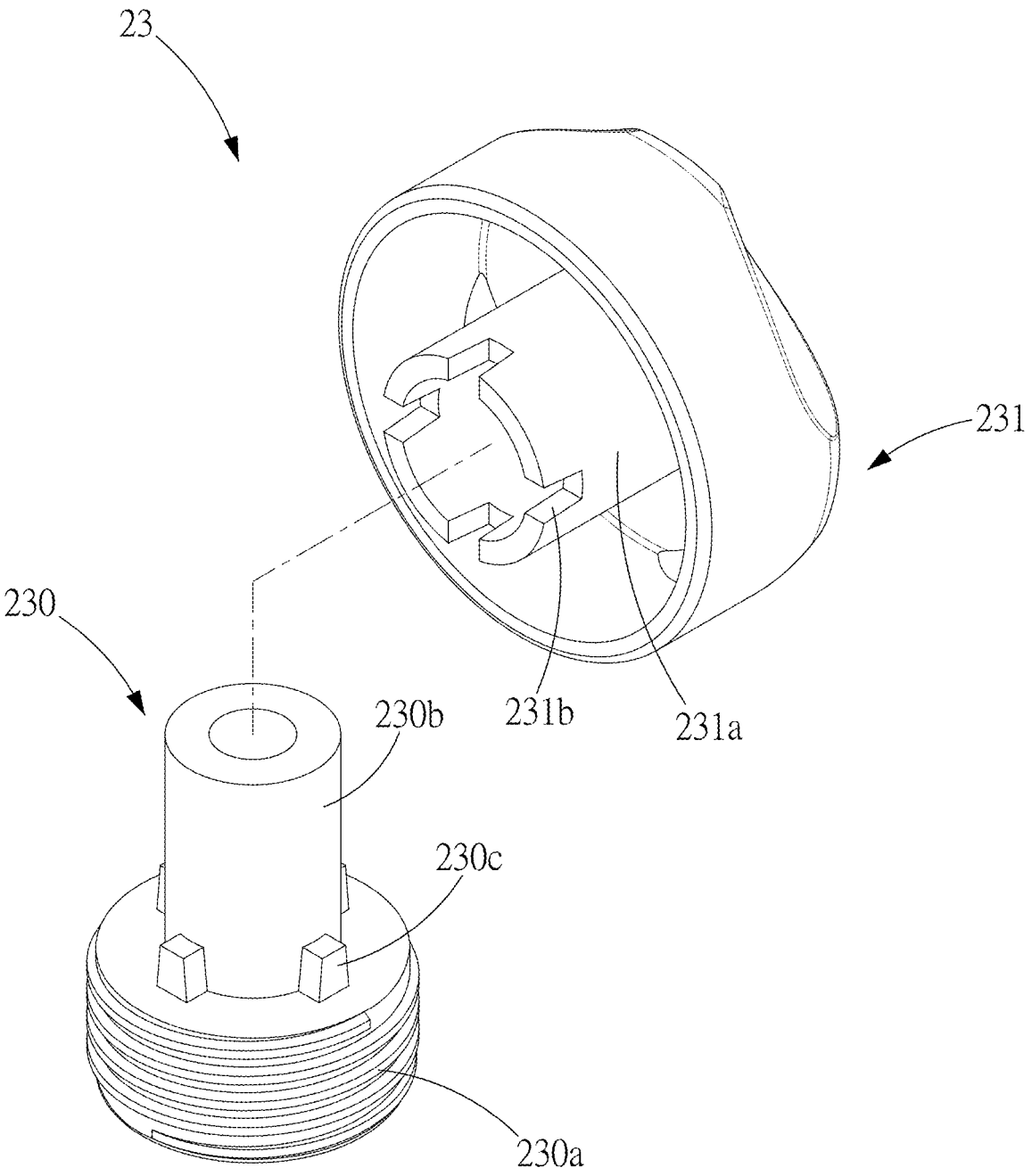
FIG. 2 is an exploded view of the control member of the preferred embodiment of the present invention.
Figure 3:
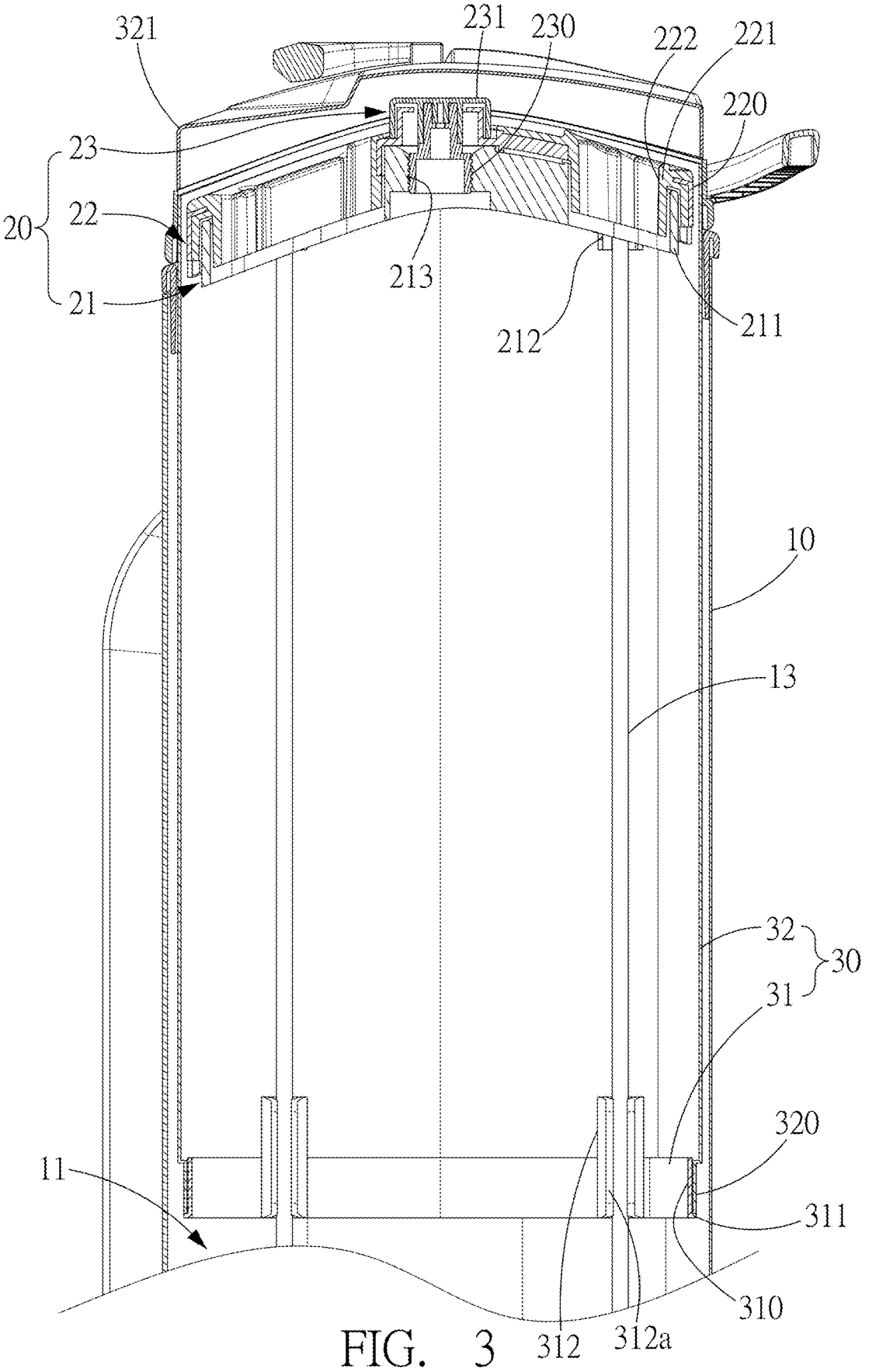
FIG. 3 is a part-sectional view of the preferred embodiment of the present invention.

As shown in FIG. 1 to FIG. 3, a golf bag of the preferred embodiment of the present invention includes a bag body 10, a head frame assembly 20, and a telescopic tube 30.

The interior of the bag body 10 includes a storage space 11, with an opening 12 on top of the bag body 10 that communicates with the storage space 11. The storage space 11 is configured to hold at least one golf club (not shown). Within the storage space 11, the bag body 10 comprises multiple supporting rods 13, wherein a lower end of each supporting rods 13 is connected to a bottom side of the bag body 10, while an upper end extends toward the direction of the opening 12. In the present preferred embodiment, the supporting rods 13 are fiberglass rods.

The head frame assembly 20 comprises a first head frame 21, a second head frame 22, and a control member 23. The first head frame 21 is a hollow annular structure with an interior divided into multiple compartments 211 by several partitions 210. The outer periphery of the first head frame 21 is surrounded by multiple hollow positioning members 212, which allow the upper ends of the supporting rods 13 to pass through. This configuration enables the first head frame 21 to be fixed within the storage space 11 of the bag body 10 and located adjacent to the opening 12. Additionally, a center of the first head frame 21 is provided with a threaded hole 213.

The second head frame 22 is detachably mounted above the first head frame 21 and is connected to the first head frame 21 via the control member 23. Specifically, the second head frame 22 includes a shell member 220 and a flexible member 221. The flexible member 221 is mounted on the shell member 220, and the flexibility of the flexible member 221 is greater than that of the shell member 220. The second head frame 22 is provided with multiple flexible holes 222 on the flexible member 221, corresponding to the compartments 211 of the first head frame 21. This design allows golf clubs to pass through the flexible holes 222 and the compartments 211 and be accommodated within the storage space 11 of the bag body 10.

The control member 23 is located between the first head frame 21 and the second head frame 22 and connects the two, allowing for switching between a closed state and an open state. When the control member 23 is switched to the closed state, the control member 23 fixes the second head frame 22 to the first head frame 21. When the control member 23 is switched to the open state, it disconnects from the first head frame 21, allowing the second head frame 22 to detach from the first head frame 21.

Specifically, in the present preferred embodiment, the control member 23 includes a screw base 230 and a knob 231. The screw base 230 has a threaded portion 230*a*, a shaft portion 230*b*, and multiple ribs 230*c*. The threaded portion 230*a* is detachably screwed into the threaded hole 213 of the first head frame 21. The shaft portion 230*b* extends from one end of the threaded portion 230*a* and enters a center of the second head frame 22, with an outer diameter of the shaft portion 230*b* being smaller than that of the threaded portion 230*a*. The ribs 230*c* are arranged around the threaded portion 230*a* and the shaft portion 230*b*, with both ends connected to the threaded portion 230*a* and the shaft portion 230*b*, protruding outward. The knob 231 is rotatably mounted at the center of the second head frame 22, with one end having a hollow tubular portion 231*a* that fits over the shaft portion 230*b* of the screw base 230. The knob 231 has multiple grooves 231*b* at an end of the tubular portion 231*a*, corresponding to the ribs 230*c*, allowing the ribs 230*c* to snap into the grooves 231*b* when the knob 231 is connected to the screw base 230, enabling synchronized rotation of the knob 231 and the screw base 230. Thus, when the knob 231 is rotated in a forward direction, the threaded portion 230*a* of the screw base 230 screws into the threaded hole 213, fixing the second head frame 22 to the first head frame 21. When the knob 231 is rotated in a reverse direction, the threaded portion 230*a* of the screw base 230 detaches from the threaded hole 213, allowing the second head frame 22 to separate from the first head frame 21.

The telescopic tube 30 includes a middle frame 31 and a tube body 32. The middle frame 31 is an annular structure, including an annular wall 310, a bottom wall 311, and multiple hollow track members 312. One end of the bottom wall 311 is connected to the bottom end of the annular wall 310, while the other end extends outward in a direction away from the annular wall 310. The track members 312 are hollow tubular components, arranged around an inner periphery of the annular wall 310 and aligned with the supporting rods 13, allowing the supporting rods 13 to pass through. Each track member 312 has a notch 312*a* on one side, extending along an axis of the supporting rods 13. An inner diameter of the track members 312 is greater than an outer diameter of the positioning members 212.

The tube body 32 is a hollow tubular structure, detachably mounted within the storage space 11 of the bag body 10. A bottom end of the tube body 32 rest against the middle frame 31, and can be operated to move in a direction toward or away from the bag body 10. The bottom end of the tube body 32 has an inward concave portion 320, with an inner diameter smaller than that of the other parts of the tube body 32. When the tube body 32 is connected to the middle frame 31, the inner wall of the inward concave portion 320 abuts against the annular wall 310 of the middle frame 31, and a bottom surface of the inward concave portion 320 rests against the bottom wall 311 of the middle frame 31. A top end of the tube body 32 has a cap 321 that can be opened and closed. When the cap 321 is opened, the tube body 32 can slide downward into the bag body 10, allowing the golf clubs to be exposed.

Figure 8:
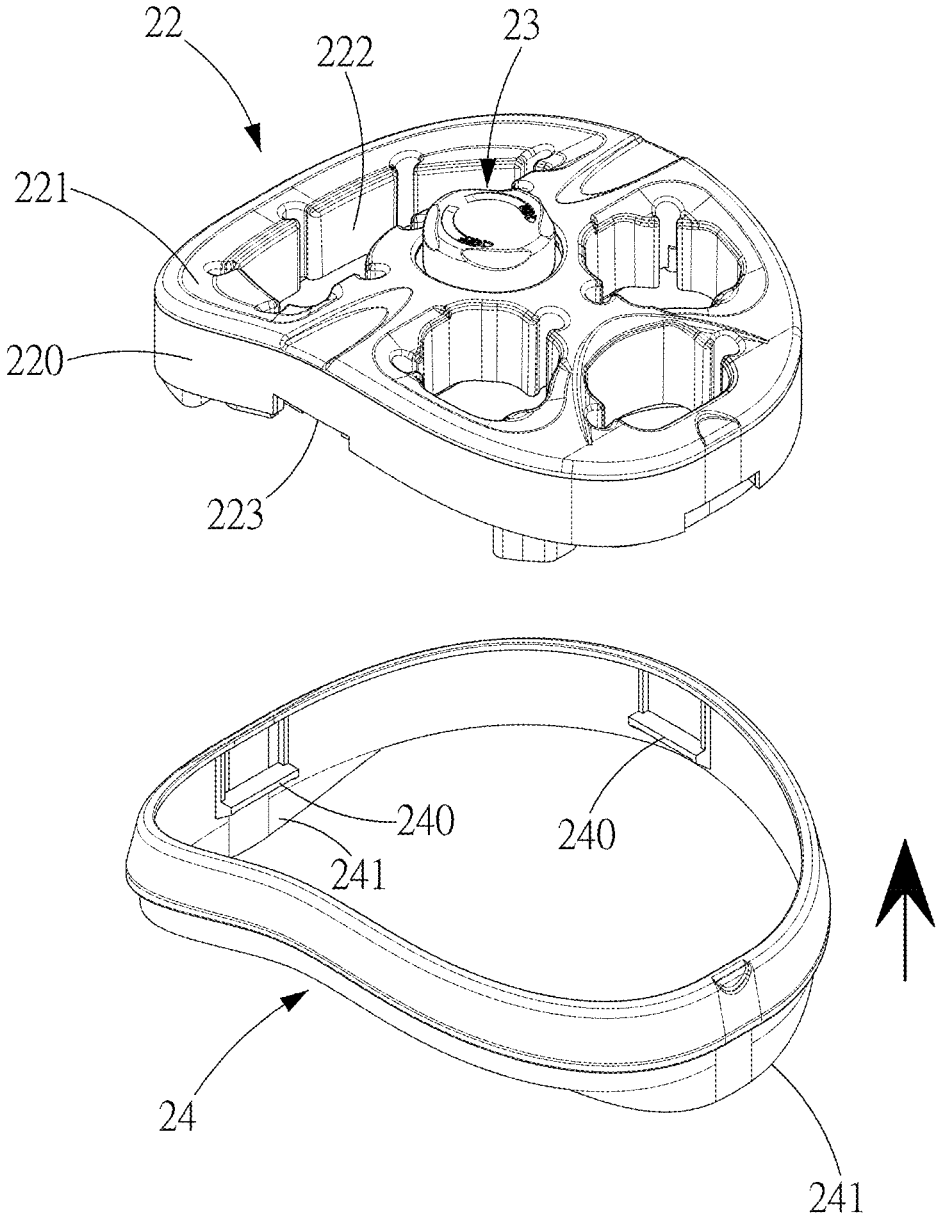
Figure 9:
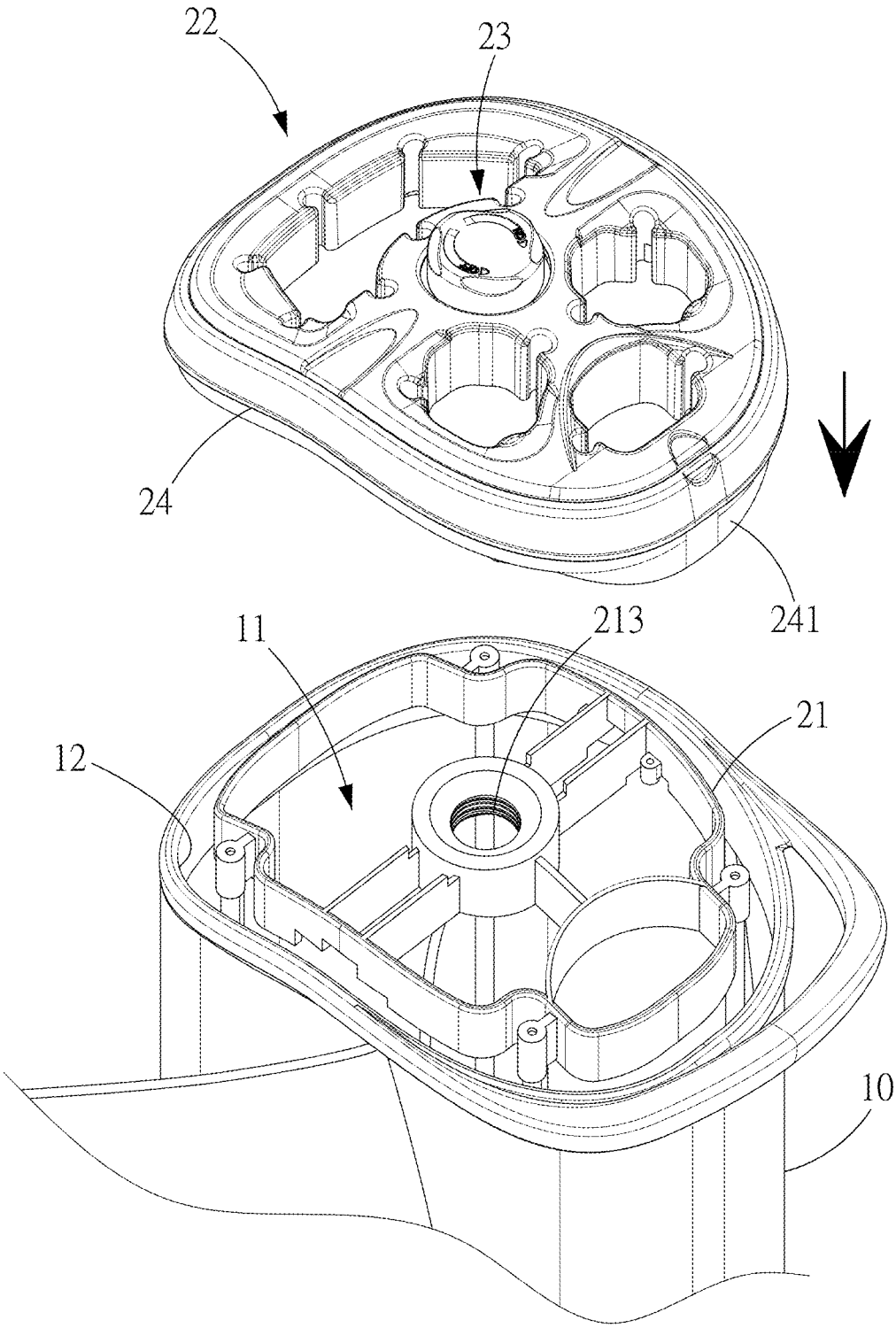
Figure 10:
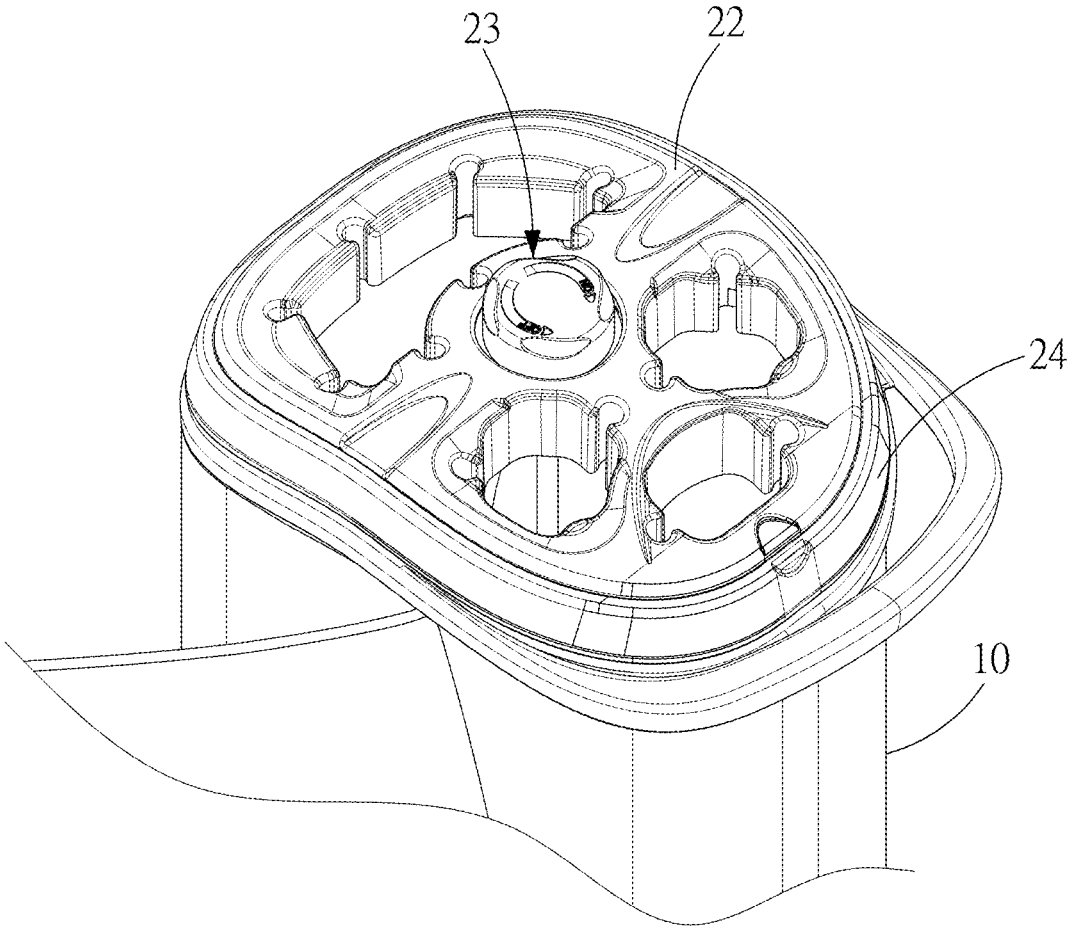

Additionally, as shown in FIG. 8, in the present preferred embodiment, the head frame assembly 20 further includes a head frame outer sleeve 24. The head frame outer sleeve 24 is detachably connected to the second head frame 22. An outer periphery of the second head frame 22 is provided with multiple engaging slots 223. An inner periphery of the head frame outer sleeve 24 is provided with multiple engaging members 240 extending inwardly, corresponding to the engaging slots 223. When the second head frame 22 is assembled with the head frame outer sleeve 24, these engaging members 240 are embedded into the engaging slots 223, forming a secure connection. The head frame outer sleeve 24 includes two extending part 241 along its longitudinal axis on opposite sides. The extending parts 241 are configured to enhance the strength of connection between the second head frame 22, and the bag body 10.

It is important to note that when the telescopic tube 30 is still installed within the bag body 10, the head frame outer sleeve 24 is not attached to the exterior of the second head frame 22. After the telescopic tube 30 is removed from the bag body 10 and before the second head frame 22 is reinstalled, the head frame outer sleeve 24 is mounted onto the exterior of the second head frame 22. The head frame outer sleeve 24 is configured to fill a gap between the second head frame 22 and the bag body 10.

Figure 4:
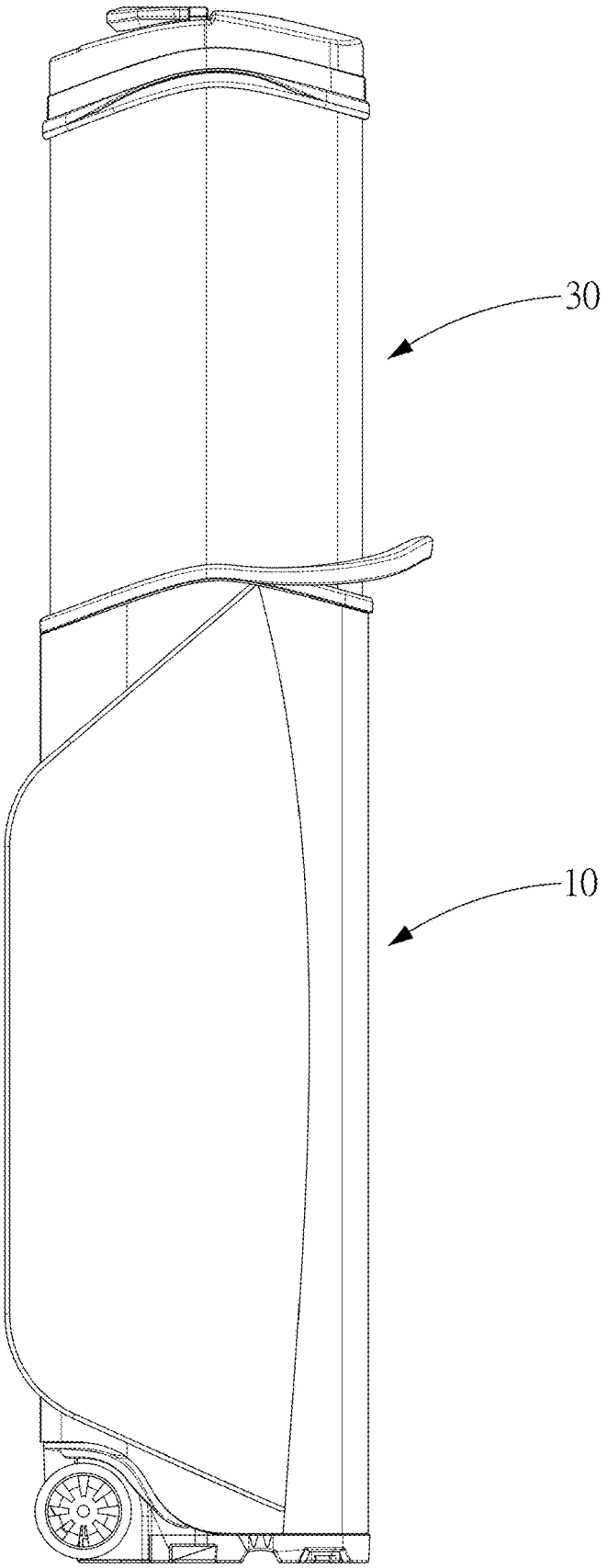
FIG. 4 and FIG. 5 are side views of the preferred embodiment of the present invention, showing the extended and non-extended states of the golf bag.
Figure 5:
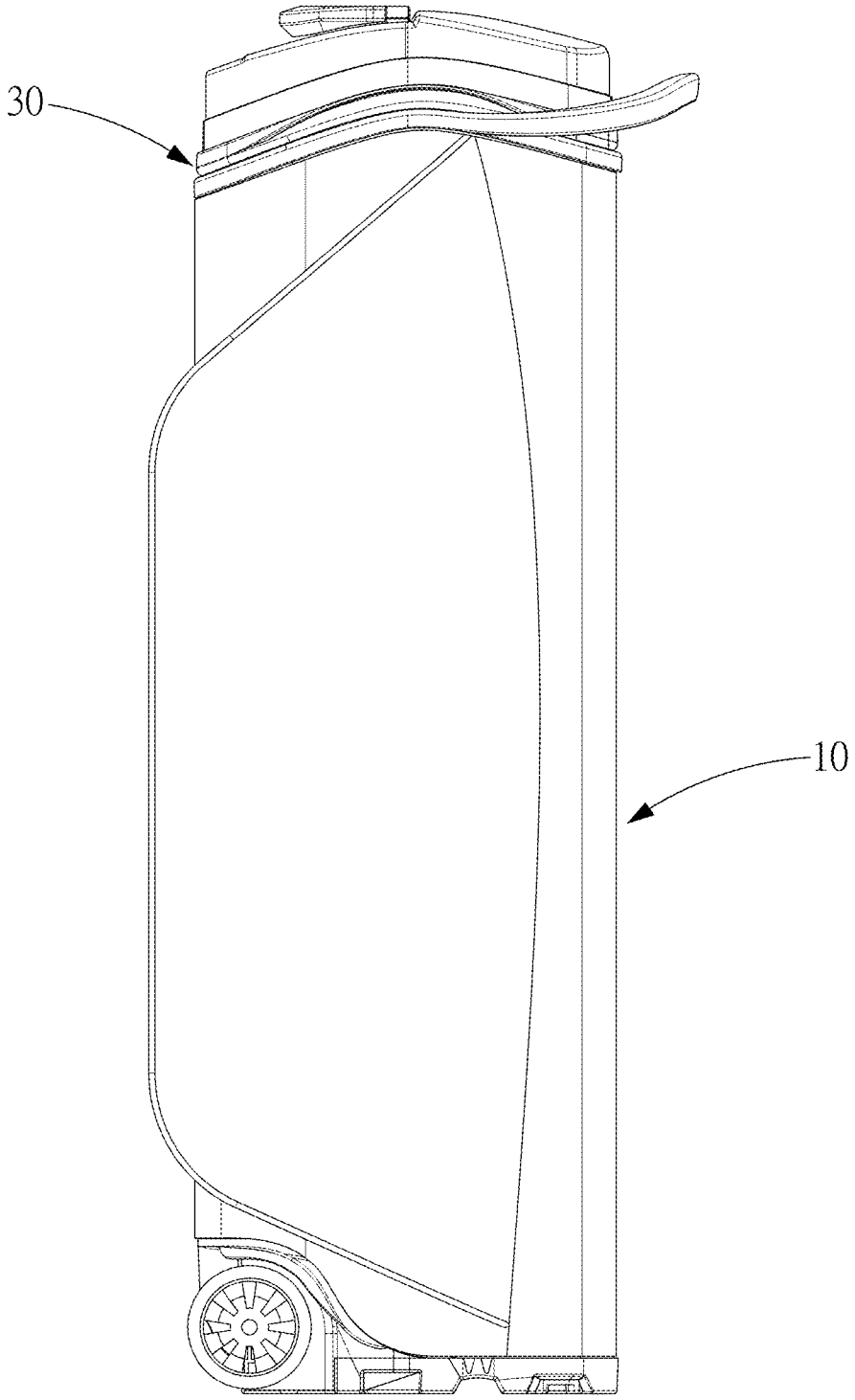
Figure 6:
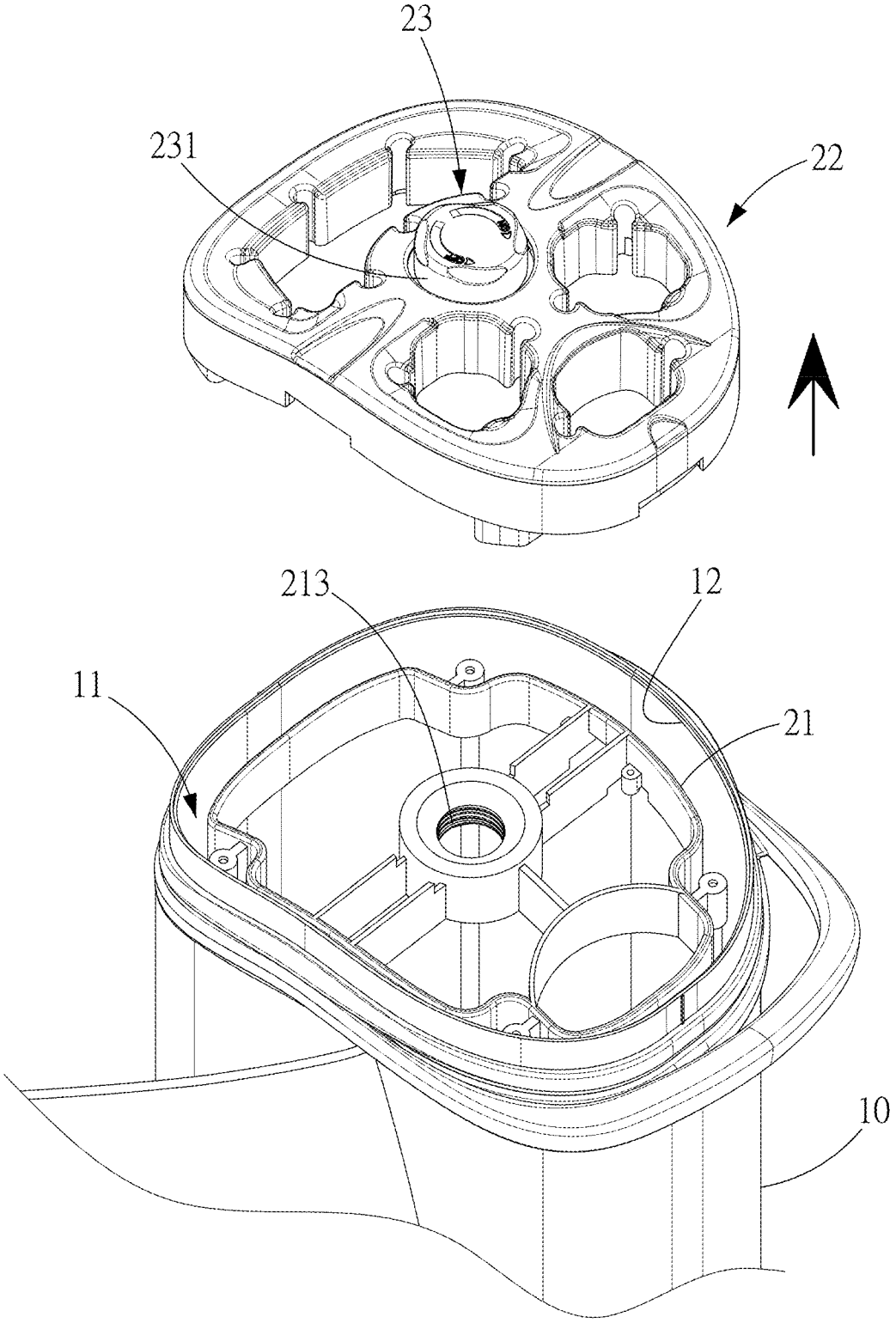
FIG. 6 to FIG. 10 are schematic views of the preferred embodiment of the present invention, showing the operational processes of detaching the telescopic tube from the golf bag.
Figure 7:
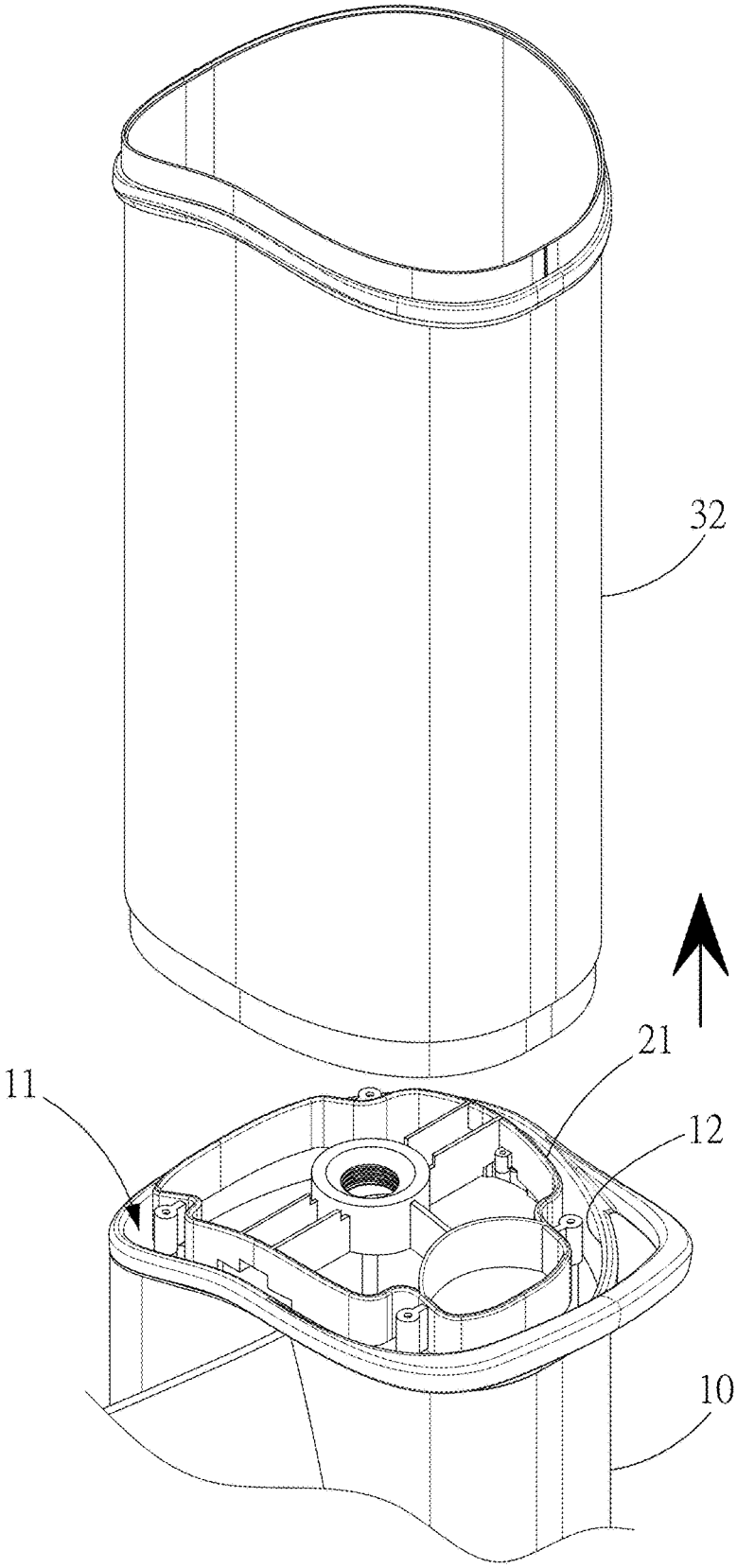

As shown in FIG. 4 and FIG. 5, when the telescopic tube 30 is installed in the bag body 10, the golf bag of the present invention can be used like a typical golf bag with a telescopic tube structure and switched between an extended state (shown in FIG. 4) and a non-extended state (shown in FIG. 5), allowing for telescopic use.

As shown in FIG. 6 through FIG. 10, if a user wants to remove the telescopic tube 30, the disassembly steps for the golf bag with a detachable telescopic tube provided by the present invention are as follows:

Second Head Frame Separation Step: The user rotates the knob 231 of the control member 23 in the reverse direction, causing the screw base 230 of the control member 23 to gradually disengage from the threaded hole 213 of the first head frame 21. This action switches the control member 23 from the closed state to the open state. In this state, the control member 23 and the second head frame 22 can be separated from the first head frame 21 and removed from the bag body 10.

Telescopic Tube Separation Step: After the second head frame 22 is removed from the storage space 11 of the bag body 10, the tube body 32 of the telescopic tube 30 is moved upward. As the tube body 32 continues to move upward, the track members 312 approach the first head frame 21 and the positioning members 212 arranged around the outer periphery of the first head frame 21. Since an inner diameter of the track members 312 is greater than an outer diameter of the positioning members 212, and the track members 312 have the notches 312*a*, the track members 312 can pass through the positioning members 212 via their hollow interior and the notches 312*a*. This allows the telescopic tube 30 to pass through the first head frame 21 without being obstructed, enabling the telescopic tube 30 to be removed from the bag body 10 through the opening 12.

Head Frame Outer Sleeve Assembly Step: Before reinstalling the second head frame 22 back into the bag body 10, the user may combine the head frame outer sleeve 24 to the bottom of the second head frame 22. This allows the head frame outer sleeve 24 to fit around the outer periphery of the second head frame 22.

Second Head Frame Reinstallation Step: Once the second head frame 22 is assembled with the head frame outer sleeve 24, the user may align the second head frame 22 with the first head frame 21 and reinstall the second head frame 22 onto the first head frame 21. After reinstallation, the user may rotate the knob 231 of the control member 23 in the forward direction, causing the screw base 230 of the control member 23 to be re-locked into the threaded hole 213 of the first head frame 21. This action switches the control member 23 to the closed state, thereby securing the second head frame 22 to the first head frame 21 again. As a result, the golf bag transforms into a non-expandable golf bag.

Additionally, if the user needs to reinstall the telescopic tube later, the user only needs to reverse the above steps to complete the process.

It must be pointed out that the embodiments described above are only some preferred embodiments of the present invention. All equivalent structures which employ the concepts disclosed in this specification and the appended claims should fall within the scope of the present invention.

What is claimed is:

1. A golf bag, comprising: a bag body having a storage space and an opening communicating with the storage space; wherein the bag body is provided with a plurality of supporting rods within the storage space, with a lower end of each support rods being fixed to a bottom side of the bag body and an upper end of each support rods extending toward the opening; a head frame assembly comprising a first head frame, a second head frame, and a control member; the first head frame being annular and having a plurality of hollow positioning members arranged on its outer periphery, wherein the supporting rods pass through the positioning members, thereby securing the first head frame within the storage space of the bag body; the second head frame being detachably connected to the first head frame by the control member, the control member being operable to switch between a closed state and an open state; wherein when the control member switches to the closed state, the control member secures the second head frame to the first head frame; when the control member switches to the open state, the control member disengages from the first head frame, allowing the second head frame to separate from the first head frame; a telescopic tube detachably arranged in the storage space of the bag body and movable along a direction towards or away from the bag body; wherein when the second head frame is detached from the bag body, the telescopic tube is removable from the opening of the bag body; wherein the telescopic tube comprises a middle frame and a tube body; the middle frame, installed within the storage space of the bag body, having an annular wall and a bottom wall; the tube body, installed within the storage space of the bag body, having an inward concave portion on one end; an inner wall of the inward concave portion abuts against the annular wall of the middle frame, and a bottom surface of the inward concave portion rests against the bottom wall of the middle frame.

2. The golf bag of claim 1, wherein an inner edge of the annular wall of the middle frame is provided with a plurality of track members respectively been passed through by the supporting rods, and an inner diameter of the track member is greater than an outer diameter of the positioning member; wherein a side of each track member is provided with a notch extending along an axial direction of the supporting rods.

3. A golf bag, comprising: a bag body having a storage space and an opening communicating with the storage space; wherein the bag body is provided with a plurality of supporting rods within the storage space, with a lower end of each support rods being fixed to a bottom side of the bag body and an upper end of each support rods extending toward the opening; a head frame assembly comprising a first head frame, a second head frame, and a control member; the first head frame being annular and having a plurality of hollow positioning members arranged on its outer periphery, wherein the supporting rods pass through the positioning members, thereby securing the first head frame within the storage space of the bag body; the second head frame being detachably connected to the first head frame by the control member, the control member being operable to switch between a closed state and an open state; wherein when the control member switches to the closed state, the control member secures the second head frame to the first head frame; when the control member switches to the open state, the control member disengages from the first head frame, allowing the second head frame to separate from the first head frame; a telescopic tube detachably arranged in the storage space of the bag body and movable along a direction towards or away from the bag body; wherein when the second head frame is detached from the bag body, the telescopic tube is removable from the opening of the bag body; wherein the control member is mounted in a center of the second head frame and includes a screw base and a knob; The screw base is detachably connected to a threaded hole of the first head frame; the knob is rotatably mounted on a top of the second head frame and connected to the screw base to driven the screw base to enter or leave the threaded hole.

4. The golf bag of claim 3, wherein the screw base comprises a threaded portion and a shaft portion; the threaded portion is detachably connected to the threaded hole of the first head frame; the shaft portion extends from an end of the threaded portion and passes through a center of the second head frame, and an outer diameter of the shaft portion is smaller than an outer diameter of the threaded portion; An end of the knob is provided with a hollow tubular portion engaged with the shaft portion of the screw base.

5. The golf bag of claim 4, wherein the screw base includes a plurality of ribs arranged around the junction between the threaded portion and the shaft portion; the tubular portion of the knob has a plurality of notches at one end, corresponding to the ribs; when the knob is connected to the screw base, the ribs engage with the notches, enabling the knob and the screw base to rotate synchronously.

6. A golf bag, comprising: A bag body having a storage space and an opening communicating with the storage space; wherein the bag body is provided with a plurality of supporting rods within the storage space, with a lower end of each support rods being fixed to a bottom side of the bag body and an upper end of each support rods extending toward the opening; a head frame assembly comprising a first head frame, a second head frame, and a control member; the first head frame being annular and having a plurality of hollow positioning members arranged on its outer periphery, wherein the supporting rods pass through the positioning members, thereby securing the first head frame within the storage space of the bag body; the second head frame being detachably connected to the first head frame by the control member, the control member being operable to switch between a closed state and an open state; wherein when the control member switches to the closed state, the control member secures the second head frame to the first head frame; when the control member switches to the open state, the control member disengages from the first head frame, allowing the second head frame to separate from the first head frame; a telescopic tube detachably arranged in the storage space of the bag body and movable along a direction towards or away from the bag body; wherein when the second head frame is detached from the bag body, the telescopic tube is removable from the opening of the bag body; wherein the head frame assembly further comprises a head frame outer sleeve detachably fitted around an outer periphery of the second head frame to fill the gap between the second head frame and the bag body when the second head frame is positioned within the storage space of the bag body.

7. The golf bag of claim 6, wherein the outer periphery of the second head frame is provided with a plurality of engaging slots, and an inner periphery of the head frame outer sleeve is provided with a plurality of engaging members extending inwardly and corresponding to the engaging slots; when the second head frame and the head frame outer sleeve are assembled, the engaging members engages with the engaging slots.

8. The golf bag of claim 6, wherein the head frame outer sleeve is not assembled with the second head frame when the telescopic tube is mounted within the bag body.

* * * * *